US006663513B2

(12) United States Patent
Howard

(10) Patent No.: US 6,663,513 B2
(45) Date of Patent: Dec. 16, 2003

(54) PITCHING PRACTICE DEVICE WITH ADJUSTABLE STRIKE ZONE INDICATOR

(76) Inventor: Stuart Alan Howard, 8351 Forest Hills Blvd., Dallas, TX (US) 75218

( * ) Notice: Subject to any disclaimer, the term of this patent is extended or adjusted under 35 U.S.C. 154(b) by 45 days.

(21) Appl. No.: 10/010,355

(22) Filed: Oct. 22, 2001

(65) Prior Publication Data

US 2003/0078117 A1 Apr. 24, 2003

(51) Int. Cl.[7] ..... A63B 69/00; A63B 71/00; A63B 63/00; F41J 3/02

(52) U.S. Cl. ..... 473/454; 473/417; 273/348; 273/407; 273/408

(58) Field of Search ..... 473/422, 417, 473/451, 454, 456, 453; 273/354, 398, 400, 402, 404, 410, 348, 127 R

(56) References Cited

U.S. PATENT DOCUMENTS

| | | | | | |
|---|---|---|---|---|---|
| 708,569 | A | * | 9/1902 | Manley | 473/454 |
| 1,592,005 | A | * | 7/1926 | Rovane | 473/454 |
| 1,879,316 | A | * | 9/1932 | Kleb | 473/454 |
| 3,312,467 | A | * | 4/1967 | Dawson | 473/454 |
| 4,210,326 | A | | 7/1980 | Booth et al. | |
| 4,473,227 | A | * | 9/1984 | Klaus | 473/454 |
| 4,497,485 | A | | 2/1985 | Macosko | |
| 4,783,070 | A | * | 11/1988 | Bauer et al. | 473/453 |
| 4,819,937 | A | * | 4/1989 | Gordon | 473/417 |
| 4,886,267 | A | * | 12/1989 | Licciardi et al. | 473/417 |
| 4,955,607 | A | | 9/1990 | Maye | |
| 5,083,774 | A | | 1/1992 | Yalvac | |
| 5,320,343 | A | * | 6/1994 | McKinney | 473/417 |
| 5,333,856 | A | | 8/1994 | Gery | |
| 5,348,291 | A | | 9/1994 | Scully | |
| 5,484,145 | A | * | 1/1996 | Shriver | 473/454 |
| 5,511,775 | A | * | 4/1996 | Parks | 473/454 |
| 5,516,115 | A | | 5/1996 | McLain | |
| 5,704,855 | A | | 1/1998 | Kellogg, Jr. | |
| 5,803,841 | A | | 9/1998 | Daskoski | |

* cited by examiner

*Primary Examiner*—Paul T. Sewell
*Assistant Examiner*—Mitra Aryanpour
(74) *Attorney, Agent, or Firm*—Monty L. Ross; Locke Liddell & Sapp LLP

(57) ABSTRACT

A pitching practice device for indicating and simulating the height and width of a strike zone for a typical batter, the device having a base slightly wider than home plate and two laterally spaced, upwardly extending posts connected to the base, the posts each having a plurality of slidably engaged sleeves that are independently adjustable to indicate the top and bottom of the strike zone, and the posts and sleeves having contrasting colors.

12 Claims, 1 Drawing Sheet

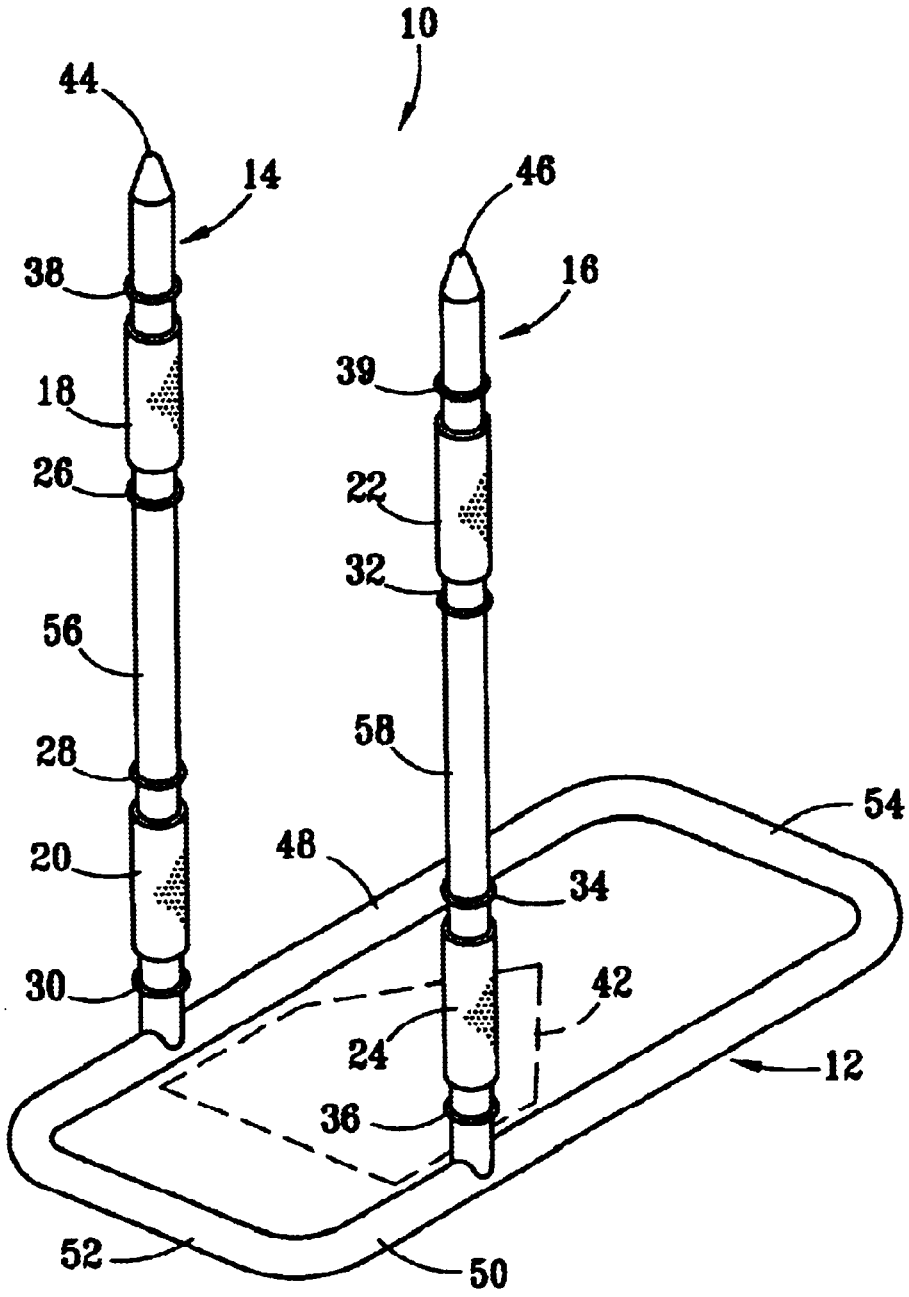
10
44
14
46
16
38
39
18
26
22
32
56
58
28
54
20
48
34
30
42
24
12
36
52
50

PITCHING PRACTICE DEVICE WITH ADJUSTABLE STRIKE ZONE INDICATOR

BACKGROUND OF THE INVENTION

1. Field of the Invention

This invention relates to simple and inexpensive pitching practice devices that are useful for indicating the boundaries of a typical strike zone to softball and baseball pitchers. More particularly, this invention relates to a pitching practice device having a strike zone indicator that can be conveniently adjusted to simulate the strike zones of batters of various sizes.

2. Description of Related Art

Numerous pitching practice devices have previously been disclosed that comprise a target at which a pitcher can "aim" when delivering a pitched ball. Those and other conventional devices often include a net or other enclosure that is adapted to receive and capture a pitched ball where no catcher is present. Still other prior art devices incorporate vertical members and cross-arms, some of which are made adjustable through the use of clamps, set screws, bolts, pins, or fabric barriers to vary the size of the target area.

Patents believed to disclose pitching practice devices typical of those found in the prior art include, for example, U.S. Pat. Nos. 4,497,485; 5,083,774; 5,333,856; 5,348,291; 5,516,115; 5,704,855; and 5,803,841.

SUMMARY OF THE INVENTION

The practice pitching device disclosed herein preferably comprises a tubular base having a width slightly greater than that of a conventional "home plate" as used in softball or baseball, and encloses an area somewhat greater than that of home plate. A tubular post extends upwardly from the base at each side of the forwardly extending portion of home plate, and the two upright posts define the width of a typical batter's strike zone. The height of the posts is desirably at least about six to twelve inches greater than the uppermost boundary of the strike zone for a batter of the size the pitcher is likely to face during a game situation. The base and posts are made of a polymeric material such as PVC, and a centrally disposed longitudinal section of each post is preferably is preferably colored to contrast with the remainder of the post. The top and bottom of the colored section of each post preferably correspond to the top and bottom, respectively, of the largest strike zone likely to be encountered by the pitcher when facing a batter.

According to another preferred embodiment of the invention, tubular indicator sleeves are slidably disposed over the laterally spaced posts. The sleeves are preferably made of polymeric foam in a color that contrasts with the colored portion of the posts. The sleeves and posts desirably cooperate to form a strike zone indicator of adjustable height. Most preferably, both the vertical dimension of the strike zone and its height above ground or floor level are adjustable when using the apparatus of the invention. The bottom sleeve on each post is desirably positioned so that the top of the bottom sleeve is at a level corresponding approximately to the bottom of the strike zone of a typical batter. The two sleeves on each post are longitudinally spaced and separated by a distance corresponding approximately to the vertical distance between the top and bottom of the strike zone of a typical batter.

Because pitchers occasionally face batters whose height is not typical, both the vertical expanse of the strike zone and its height above ground or floor level are easily adjustable by repositioning the sleeves on the posts.

BRIEF DESCRIPTION OF THE DRAWINGS

The apparatus of the invention and its method of use are further described and explained in relation to the drawing, which is a front perspective view of a preferred embodiment of the practice pitching device of the invention.

DESCRIPTION OF THE PREFERRED EMBODIMENTS

Referring to the drawing, pitching practice device 10 of the invention preferably comprises base 12 and laterally spaced upright posts 14, 16, respectively. Base 12 is depicted as a substantially rectangular structure further comprising side members 48, 50 and end members 52, 54. Side members 48, 50 are preferably spaced apart a distance slightly greater than the maximum width of a conventional home plate 42. Side members 48, 50 preferably extend rearwardly from posts 14, 16 a distance greater than the length of home plate 42 to provide stability against tip-over if either of posts 14, 16 is struck by a pitched ball. Side members 48, 50 preferably extend forwardly of posts 14, 16 a lesser distance than that of the rearward extension to provide additional stability and resistance to rocking. End members 52, 54 of base 12 provide stability and rigidity to pitching practice device 10 and also maintain the desired lateral spacing between side members 48, 50 and between the bases of posts 14, 16 relative to home plate 42. During use, base member 12 of pitching practice device 10 can be positioned over home plate 42 as shown, with posts 14, 16 being placed adjacent to the sides of the front portion of the plate. It is understood, however, that no home plate 42 is required during use of pitching practice device 10 because the width of the strike zone is simulated by the lateral separation between posts 14, 16.

Although base 12 is shown in the drawing and is described above as being rectangular, it will be appreciated upon reading the disclosure that other base configurations can also be used within the scope of the invention, provided that the base is stable when resting on an underlying support surface and provided that the width of the base is adequate to support posts 14, 16 so that they are separated by a lateral distance approximating the width of a simulated strike zone.

Side members 48, 50 and end members 52, 54 of base 12 are preferably substantially cylindrical, although it will be appreciated that other cross-sectional configurations can be similarly used. The elongated, preferably tubular, members can be made, for example, of metal, plastic or fiber-reinforced composites. The diameter and wall thickness can vary according to the properties of the material selected, but will preferably be sufficient to produce a relatively rigid base 12 capable of supporting posts 14, 16. According to a particularly preferred embodiment of the invention, base 12 is formed from polymeric pipe or tubing. Such pipe or tubing can be continuously formed, shaped and welded into the desired configuration, assembled from segments using bolts, screws or other fasteners, or can be constructed from PVC pipe segments that are interconnected by conventional PVC fittings such as elbows, tees, etc., and cemented into the desired configuration using a conventional solvent-based adhesive. Alternatively, base 12 can be made of releasably connectable segments that are not permanently welded, cemented or otherwise joined together.

Posts 14, 16 are preferably substantially cylindrical and are vertically disposed relative to base 12. The lower end of each post is preferably rigidly connected to base 12, although it is not required that the connection be permanent. For example, posts 14, 16 can be made insertable into upwardly directed openings or sockets in base 12 to facilitate disassembly for storage or shipment. Posts 14, 16 are preferably made from the same or similar materials as base 12, with the ends distal to base 12 desirably comprising tapered end caps 44, 46 for reasons discussed below. Posts 14, 16 desirably extend upwardly from base 12 a distance that is at least about 6 to 12 inches greater than the height of the top of the strike zone for a batter of the greatest height likely to be faced by the user during a game. According to a particularly preferred embodiment of the invention, posts 14, 16 comprise centrally disposed longitudinal sections 56, 58, respectively, that are colored to contrast with the remainder of each post. Contrasting colored sections 56, 58 desirably extend continuously from the top of the highest strike zone to the bottom of the lowest strike zone of any batter that a pitcher using device 10 is likely to face.

Coaxially aligned sleeves 18, 20 and 22, 24 are preferably disposed around posts 14, 16, respectively, and each coaxially aligned sleeve is slidably adjustable on its respective post so as to permit the user to selectively vary its height on the post and the vertical separation between it and the other sleeve on the same post. Sleeves 18, 20, 22, 24 are preferably made of a foamed elastomeric polymer but can also be made of other materials such as rubbery polymers, plastic or fabric sheet material, or the like. Sleeves 18, 20, 22, 24 are preferably cut from tubular, foamed polymeric extrudates having an inside diameter that is slightly greater than the outside diameter of posts 14, 16. Such sleeves can be attached to posts 14, 16 by sliding them onto the posts over tapered end caps 44, 46, respectively. Alternatively, the sidewall of each sleeve can be slit longitudinally to permit it to be spread open sufficiently to wrap it around a post, after which it will desirably again relax to assume a substantially tubular shape. Sleeves made from plastic or fabric sheet material will desirably be sufficiently pliable to allow them to be rolled into a substantially cylindrical shape and will comprise fasteners such as snaps, Velcro® tabs or straps, ties, or the like, to maintain that shape during use. Sleeves 18, 20, 22, 24 are desirably colored so as to contrast with colored sections 56, 58 of posts 14, 16 to facilitate adjustment of the height and vertical expanse of the simulated strike zone.

The inside diameter of sleeves 18, 20, 22, 24 is desirably great enough, relative to the outside diameter of posts 14, 16, to permit the sleeves to be moved up and down posts 14, 16 without difficulty, but also small enough to insure that each sleeve can be selectively positioned at a desired height on its post. Such positioning is preferably facilitated by the use of elastomeric O-rings 26, 30, 32 and 36 that can be placed around posts 14, 16 by sliding them onto the posts over tapered end caps 44, 46, respectively. The height of each sleeve 18, 20, 22, 24 on its respective post is desirably controlled by positioning one of O-rings 26, 30, 32, 36, or other similarly effective means, directly beneath it to prevent the sleeve from sliding downwardly from a preferred height while the pitcher is practicing. For illustrative purposes, FIG. 1 depicts separation between the sleeves and their respective O-rings but in actual use each sleeve will desirably be in contacting and abutting relationship to the O-ring disposed immediately below it.

Additional O-rings 28, 34, 38, 39 can also be positioned above each sleeve if desired, and O-rings 38, 39 can assist in preventing sleeves 18, 22 from sliding off posts 14, 16 if practice pitching device 10 is upended during use or if posts 14, 16 are disassembled from base 12 for storage between uses. Annular grooves can also be provided at predetermined locations on the outside surface of each post 14, 16 if desired to provide seating areas for the O-rings at selected heights on the posts. Similarly effective means other than O-rings can also be used within the scope of the invention for positioning sleeves at desired heights on the posts. As an example, and without limitation, longitudinally split sleeves can be attached by Velcro® hook and loop fasteners to cooperatively aligned patches or strips secured to posts 14, 16.

It should be understood that the apparatus of the invention is primarily intended for use in pitching practice where both a pitcher and catcher are present. According to a particularly preferred embodiment of the invention, sleeves 18, 20, 22, 24 are made in a bright color that contrasts with the color of posts 14, 16. During use of practice pitching device 10, sleeves 20, 24 are preferably positioned on posts 14, 16 so that the top of each sleeve is at a height corresponding to the bottom of the strike zone for a typical batter. Sleeves 18, 22, on the other hand, are preferably positioned on posts 14, 16 so that the bottom of each sleeve is at a height corresponding to the top of the strike zone for a typical batter. If the sleeve color contrasts with the post color between each set of vertically spaced sleeves, both the height and width of a typical batter's strike zone will be readily apparent to the pitcher during practice when using the device of the invention. Furthermore, the pitcher can easily practice pitching to batters of different heights by slidably adjusting the height of the sleeves on the posts, preferably maintaining each upper sleeve above the top of the intended strike zone and each lower sleeve below the bottom of the intended strike zone. If desired, vertically spaced indicia can be provided on posts 14, 16 to assist the user in positioning each of sleeves 18, 20, 22, 24 at a desired height.

According to another preferred embodiment of the invention, ports can be provided for the insertion of sand or other ballast material into the tubular base to reduce the likelihood of tipping if an upright member is struck by a pitched ball. Such material can also be introduced into base 12 through posts 14, 16 by removing end caps 44, 46. In such case, care should be taken to insure that substantially all of the ballast material flows downwardly through the post and into the base to avoid making practice pitching device 10 more top-heavy and prone to tipping over during use. Where device 10 is assembled by inserting posts 14, 16 into upwardly facing female connectors (not shown) of base 12, as may be present where device 10 is assembled from PVC pipe with tees providing an opening for insertion of the posts, ballast can be inserted through such connectors prior to inserting the posts.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed is:

1. A pitching practice device indicating a simulated strike zone height and width, the device comprising:

a base having a width at least as great as a simulated strike zone width;

two posts extending vertically upward from the base and supported only by the base, the posts being taller than a simulated strike zone height and being separated by a lateral distance approximating the simulated strike zone width and devoid of structure between the posts or inside the simulated strike zone;

two sleeves coaxially aligned with and slidably disposed on each post to define a longitudinal section of each post that is visible between the sleeves; and at least one elastomeric O-ring adjustably positioning each sleeve on the post on which the sleeve is slidably disposed to indicate one of an upper limit and a lower limit of the simulated strike zone distance not height;

the sleeves on each post contrasting in color with the longitudinal section of the post between the sleeves.

2. The pitching practice device of claim 1 wherein the base is substantially rectangular.

3. The pitching practice device of claim 1 wherein the base comprises at least one tubular member.

4. The pitching practice device of claim 1 wherein each post has a tapered end cap disposed opposite the base.

5. The pitching practice device of claim 1 wherein the sleeves are made of a foamed polymeric material.

6. The pitching practice device of claim 1 comprising an elastomeric O-ring disposed above and below each slidably disposed sleeve.

7. The pitching practice device of claim 1 wherein the base has a portion extending forwardly of the posts.

8. The pitching practice device of claim 1 wherein at least a portion of the base is made of a substantially rigid polymeric material.

9. The pitching practice device of claim 1 wherein at least a portion of the posts is made of a substantially rigid polymeric material.

10. The pitching practice device of claim 1 wherein the longitudinal section of each post contrasts in color with a portion of each post disposed above the longitudinal section and a portion of each post disposed below the longitudinal section.

11. The pitching practice device of claim 1 wherein the base and posts comprise metal tubing.

12. A pitching practice device indicating a simulated strike zone height and width, the device comprising:

a rectangular base having a width at least as great as a simulated strike zone width;

two posts extending vertically upward from the base and supported only by the base, the posts being taller than a simulated strike zone height and being separated by a lateral distance approximating the simulated strike zone width and devoid of structure between the posts or inside the simulated strike zone;

the base and posts constructed of substantially rigid, tubular polymeric material;

two foamed polymeric sleeves coaxially aligned with and slidably disposed on each post to define a longitudinal section of each post that is visible between the sleeves; and at least one elastomeric O-ring adjustably positioning each sleeve on the post on which the sleeve is slidably disposed to indicate one of an upper limit and a lower limit of the simulated strike zone height;

the sleeves on each post contrasting in color with the longitudinal section of the post between the sleeves.

* * * * *

UNITED STATES PATENT AND TRADEMARK OFFICE

CERTIFICATE OF CORRECTION

PATENT NO. : 6,663,513 B2
DATED : December 16, 2003
INVENTOR(S) : Stuart Alan Howard It is certified that error appears in the above-identified patent and that said Letters Patent is hereby corrected as shown below:

Column 1,
Line 44, delete the second occurrence of "is preferably".

Column 3,
Line 39, delete "Velcro® and after "strap" insert -- of VELCRO brand hook and loop fasteners --.

Column 4,
Line 9, delete "Velcro®" and insert -- VELCRO brand -- in place thereof.

Column 5,
Line 4, replace "adjustably positioning each sleeve on the post on which the sleeve is slidably disposed to indicate one of an upper limit and a lower limit of the simulated strike zone height" with -- disposed around each post in contacting and abutting relation below each sleeve --.

Column 6,
Line 23, replace "adjustably positioning each sleeve on the post on which the sleeve is slidably disposed to indicate one of an upper limit and a lower limit of the simulated strike zone height" with -- disposed around each post in contacting and abutting relation below each sleeve --.

Signed and Sealed this

Sixth Day of April, 2004

JON W. DUDAS
*Acting Director of the United States Patent and Trademark Office*